US011382486B2

(12) United States Patent
Tanquero et al.

(10) Patent No.: US 11,382,486 B2
(45) Date of Patent: Jul. 12, 2022

(54) TINTED CONSOLE COVER FOR AN APPLIANCE

(71) Applicant: Haier US Appliance Solutions, Inc., Wilmington, DE (US)

(72) Inventors: Deanna Mariel Moya Tanquero, Miami Lakes, FL (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 127 days.

(21) Appl. No.: 16/545,533

(22) Filed: Aug. 20, 2019

(65) Prior Publication Data

US 2021/0052130 A1 Feb. 25, 2021

(51) Int. Cl.
*A47L 15/42* (2006.01)

(52) U.S. Cl.
CPC ..... *A47L 15/4293* (2013.01); *A47L 15/4265* (2013.01); *A47L 15/4274* (2013.01)

(58) Field of Classification Search
CPC ..... A47L 15/4293; A47L 15/00–508
See application file for complete search history.

(56) References Cited

U.S. PATENT DOCUMENTS 7,928,857 B2 4/2011 Olesen et al.
2006/0232997 A1* 10/2006 Rosenbauer ..... F25D 29/005 362/621
2008/0273016 A1* 11/2008 Helgesen ..... A47L 15/4293 345/173
2012/0320615 A1* 12/2012 Englert ..... G09F 13/04 362/511
2015/0192288 A1* 7/2015 Kim ..... F21V 33/0044 362/253
2017/0258290 A1* 9/2017 Fletty ..... A47L 15/4297

FOREIGN PATENT DOCUMENTS

CA 2741874 A1 5/2010
CN 204010550 U 12/2014

* cited by examiner

*Primary Examiner* — Spencer E. Bell
(74) *Attorney, Agent, or Firm* — Dority & Manning, P.A.

(57) ABSTRACT

A dishwasher appliance having a console assembly equipped with light bleed prevention features is provided. In one aspect, the dishwasher includes a cabinet, a door rotatably mounted to the cabinet, and a console assembly mounted to the door. The console assembly includes a light source operable to emit light into a console cover. A light blocking film is mounted to a top surface of the console cover and defines a light pass-through opening through which light may pass to illuminate an indicia. The console cover includes one or more edges that may be exposed to an ambient environment. The console cover is formed at least in part of a non-clear resin such that light is allowed to travel through the console cover and through the light pass-through opening yet light bleed stemming from the one or more edges is not visible to a human eye.

16 Claims, 5 Drawing Sheets

TINTED CONSOLE COVER FOR AN APPLIANCE

FIELD OF THE INVENTION

The present disclosure relates generally to appliances, and more particularly to dishwasher appliances having a console assembly equipped with light bleed prevention features.

BACKGROUND OF THE INVENTION

Dishwasher appliances generally include a cabinet and a tub disposed therein that defines a wash chamber. Rack assemblies can be mounted within the wash chamber of the tub for receipt of articles for washing. Multiple spray assemblies can be positioned within the wash chamber for applying or directing wash fluid towards articles positioned within the rack assemblies in order to clean such articles. Further, dishwasher appliances typically include a door rotatably coupled with the cabinet for providing selective access to the wash chamber.

The door can include a console assembly that includes a controller, user input selectors or buttons, light sources for illuminating selected input selectors or other indicia, and a console cover formed of a non-clear resin. A film can be placed over the top surface of the console cover. Light emitted by the light sources is directed into the console cover and eventually passes through openings in the film, e.g., to light up a selected input selector. In some instances, light can escape or bleed from the console cover, particularly at the edges that are not covered by the light-blocking film. Users may find light bleed from the console cover undesirable and light bleed decreases the lumen intensity of the light illuminating selected input selectors. Placing light-blocking film over the edges of the console cover can be labor intensive, expensive, and can cause unsatisfactory adherence of the film to the console cover.

Accordingly, an appliance, such as a dishwasher appliance, having light bleed prevention features that addresses one or more of the challenges noted above would be useful.

BRIEF DESCRIPTION OF THE INVENTION

Aspects and advantages of the invention will be set forth in part in the following description, may be apparent from the description, or may be learned through practice of the invention.

In one aspect, an appliance is provided. The appliance includes a cabinet and a door operatively coupled with the cabinet and movable between a closed position and an open position. The appliance also includes a console assembly mounted to the door. The console assembly includes a console cover having a top surface and a bottom surface spaced from the top surface. The console assembly also includes a light source positioned below the bottom surface of the console cover, the light source operable to emit light into the console cover. Further, the console assembly includes a light blocking film mounted to the top surface of the console cover, the light blocking film operable to prevent light from passing therethrough and defining a light pass-through opening through which light passes when the light source emits light, wherein the console cover is formed at least in part of a non-clear resin.

In another aspect, a dishwasher appliance is provided. The dishwasher appliance includes a cabinet. The dishwasher appliance also includes a tub positioned within the cabinet and defining a wash chamber for receipt of articles for washing. In addition, the dishwasher appliance includes a door operatively coupled with the cabinet and movable between a closed position and an open position for providing selective access to the wash chamber. Further, the dishwasher appliance includes a console assembly mounted to the door. The console assembly includes a console cover having a top surface, a bottom surface spaced from the top surface, and one or more edges extending between the bottom surface and the top surface. Further, the console assembly includes a light source positioned below the bottom surface of the console cover, the light source operable to emit light into the console cover. Moreover, the console assembly includes a light blocking film mounted to the top surface of the console cover, the light blocking film operable to prevent light from passing therethrough and defining a light pass-through opening through which light passes when the light source emits light, the light pass-through opening and the light source being aligned. The console cover is formed at least in part of a non-clear resin that is substantially opaque such that, when light is emitted by the light source, light emitted by the light source that passes through the console cover and the light pass-through opening is visible to a human eye and light bleed from the one or more edges is not visible to the human eye.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
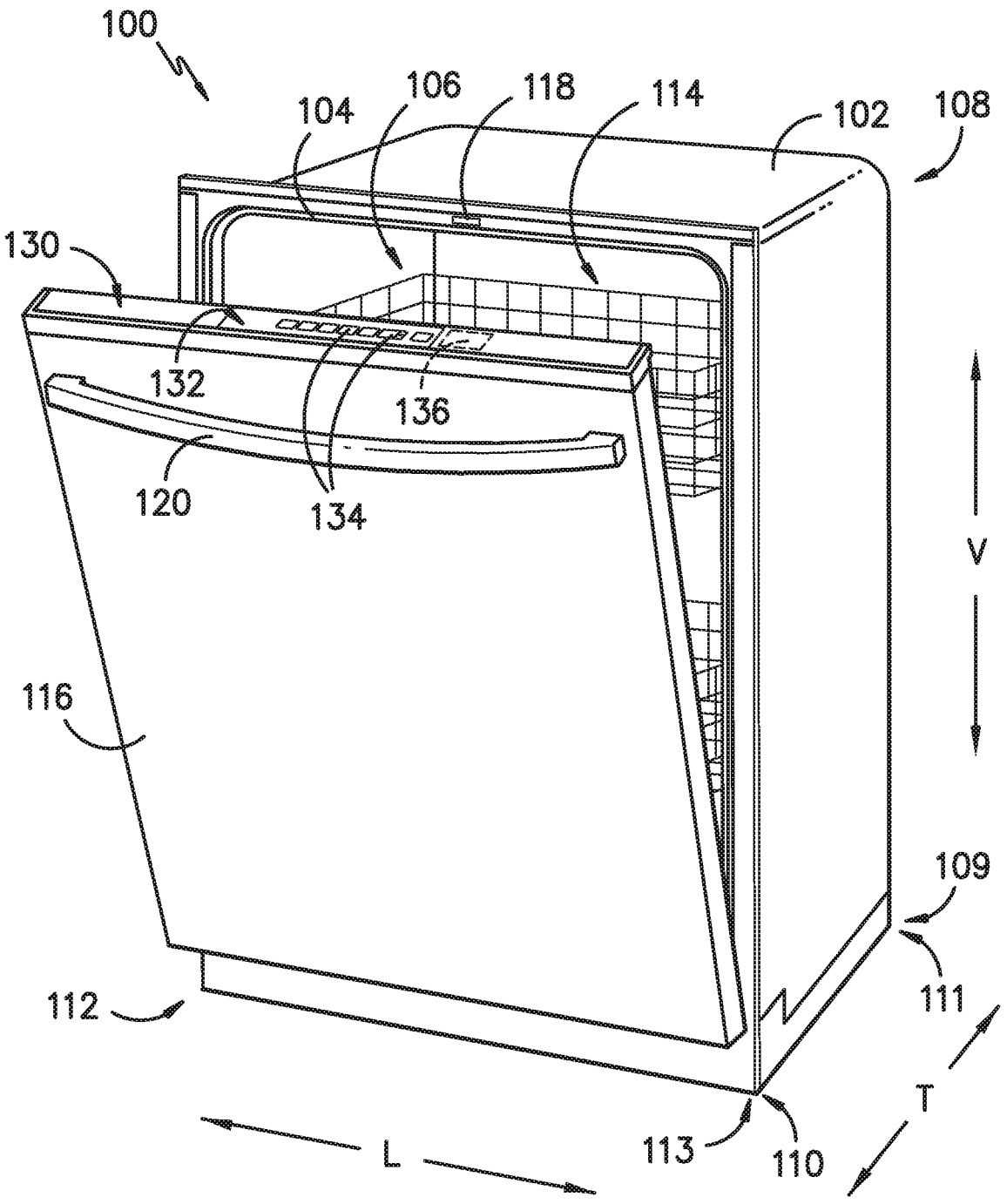
FIG. 1 provides a perspective view of a dishwasher appliance according to an example embodiment of the present disclosure with a door of the dishwasher depicted in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwasher. The term "wash cycle" is intended to refer to one or more periods of time during which a dishwasher operates while containing the articles to be washed and uses a detergent and water to e.g., remove soil particles including food and other undesirable elements from the articles. The term "rinse cycle" is intended to refer to one or more periods of time during which the dishwasher operates to remove residual soil, detergents, and other undesirable elements that were retained by the articles after completion of the wash cycle. The term "drain cycle" is intended to refer to one or more periods of time during which the dishwasher operates to discharge soiled water from the dishwasher. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a fifteen percent (15%) margin of error of the stated value.

FIG. 1 provides a dishwashing appliance or dishwasher 100 according to an example embodiment of the present disclosure. It should be appreciated, however, that the present subject matter is not limited to any particular style, model, or configuration of dishwasher 100. The embodiment depicted in FIG. 1 is for illustrative purposes only. As depicted, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 positioned therein. Tub 104 defines a wash chamber 106 configured for receipt of articles for washing, such as pots, pans, dishes, silverware, etc. Cabinet 102 extends between a top 108 and a bottom 109 along the vertical direction V, between a front 110 and a back 111 along the transverse direction T, and a first side 112 (e.g., a left side) and a second side 113 (e.g., a right side) along the lateral direction L. Tub 104 includes or defines a front opening 114.

A door 116 is operatively coupled with cabinet 102. Door 116 provides selective access to wash chamber 106. For this embodiment, door 116 is hinged at its bottom with cabinet 102 for movement between a normally closed vertical position (not shown), wherein the wash chamber 106 is sealed shut for washing operation at front opening 114, and an open position for loading and unloading of articles from dishwasher 100. Dishwasher 100 includes a door closure mechanism or assembly 118 that is used to lock and unlock door 116 for accessing and sealing wash chamber 106. Door 116 includes a handle 120 that a user may grip to move door 116 between the open and closed positions.

Dishwasher 100 includes various features for washing articles within wash chamber 106. For instance, dishwasher 100 can include rack assemblies mounted within the wash chamber 106 of tub 104 for receipt of articles for washing. Multiple spray assemblies can be positioned within the wash chamber 106 for applying or directing wash fluid towards or onto articles positioned within the rack assemblies in order to clean such articles. Such features are known in the art and thus will not be explained in detail herein.

As further shown in FIG. 1, dishwasher 100 is equipped with a console assembly 130. For this embodiment, console assembly 130 is located at a top portion or top end of door 116. However, console assembly 130 can be located in other suitable locations as well. For instance, in some embodiments, console assembly 130 can be located along a side of door 116. Generally, console assembly 130 provides an interface that facilitates user interaction with dishwasher 100. For instance, a user can select and execute various cycles (e.g., wash cycles and/or drying cycles) and settings using console assembly 130. Particularly, console assembly 130 includes a user interface 132. User interface 132 includes controls or input selectors 134 that allow a user to select various operational features and modes as well as to monitor progress of dishwasher 100. The input selectors 134 can be one or more of a variety of electrical, mechanical or electro-mechanical input devices, including e.g., rotary dials, push buttons, and touch pads. In some embodiments, the user interface 132 may represent a general purpose I/O ("GPIO") device or functional block. The user interface 132 may include a display component, such as a digital or analog display device designed to provide operational feedback to a user. The user interface 132 may be in communication with a controller 136 via one or more signal lines or shared communication busses.

Controller 136 is operatively configured to regulate operation of dishwasher 100. Controller 136 can include one or more memory devices and one or more processors, such as general or special purpose microprocessors operable to execute programming instructions or micro-control code associated with a cleaning cycle, which can include a wash and drying cycle, for example. The one or more memory devices can represent random access memory such as DRAM or read only memory such as ROM or FLASH. In some embodiments, the one or more processors execute programming instructions stored in the one or more memory devices. The one or more memory devices may be separate components from the one or more processors or may be included onboard within the one or more processors. Alternatively, controller 136 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. In some embodiments, input/output ("I/O") signals may be routed between the control system and various operational components of dishwasher 100 along wiring harnesses that may be routed through the bottom of door 116, for example.

Figure 2:
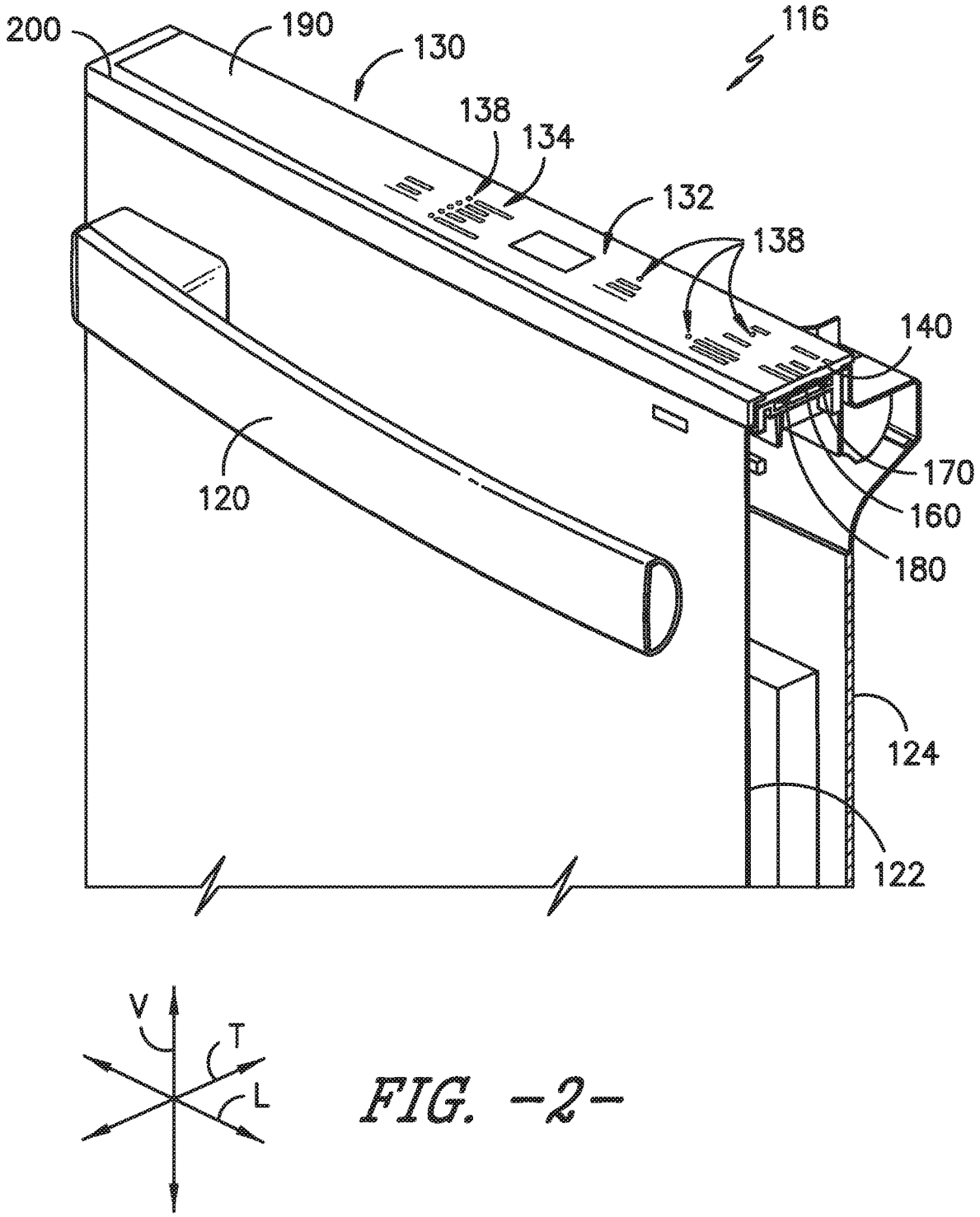
FIG. 2 provides a perspective, cross sectional view of the door of the dishwasher appliance of FIG. 1.
Figure 3:
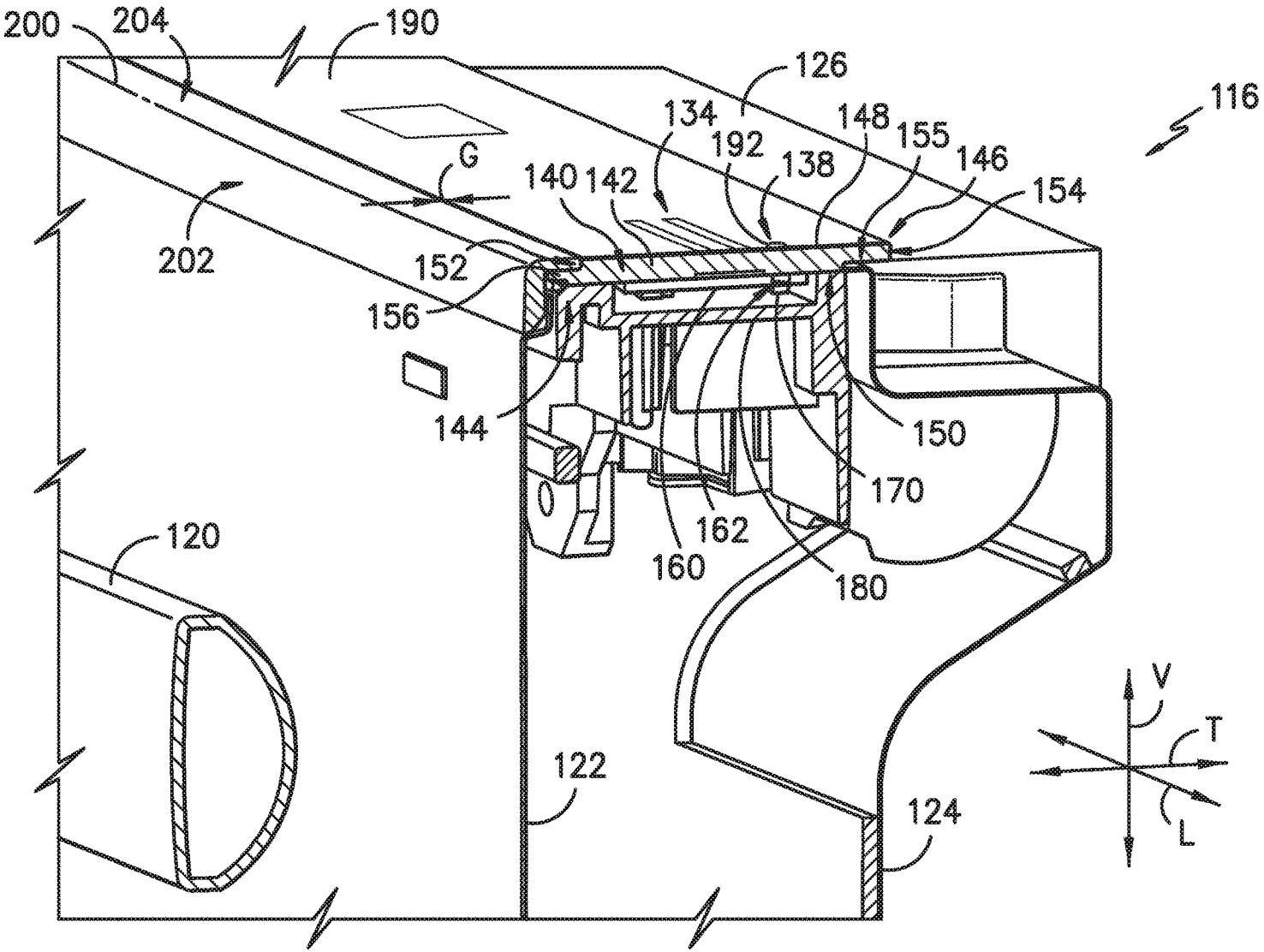
FIG. 3 provides a close up, perspective cross-sectional view of the door of FIG. 1.
Figure 4:
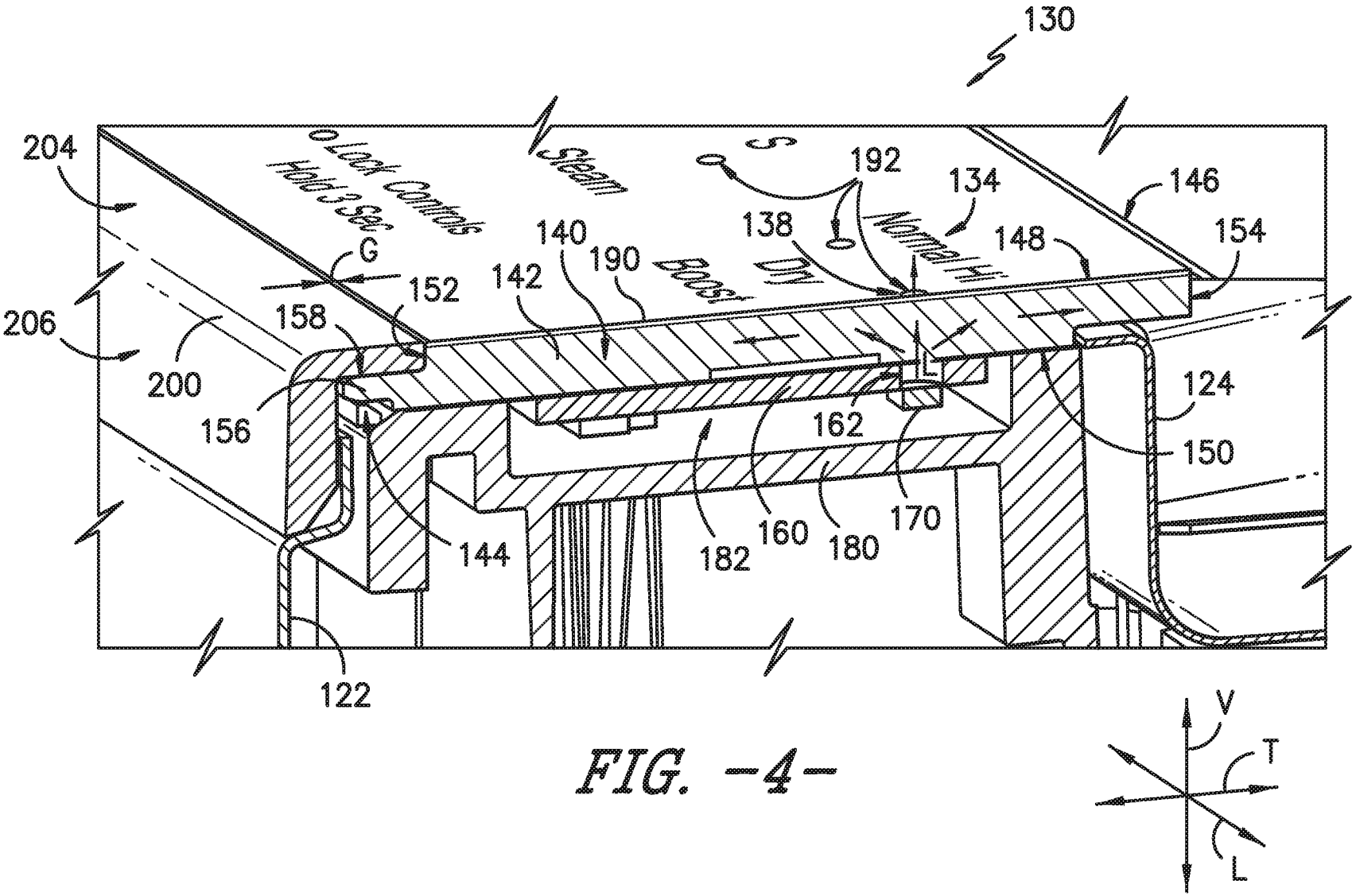
FIG. 4 provides another close up, perspective cross-sectional view of the door of FIG. 1.

FIGS. 2, 3, and 4 provide perspective cross-sectional views of door 116 of the dishwasher 100 of FIG. 1 and depict various features of console assembly 130. As shown, door 116 includes an outer panel 122 and an inner panel 124 spaced from outer panel 122, e.g., along the transverse direction T. Outer panel 122 is exposed to an ambient or exterior environment while inner panel 124 faces wash chamber 106 of tub 104 (FIG. 1), e.g., when door 116 is in the closed position. Generally, as noted above, console assembly 130 is mounted to door 116. Moreover, for facilitating the disclosure of console assembly 130, the relative positions of the elements of console assembly 130 will be explained generally with reference to door 116 in the closed or vertical position.

Console assembly 130 includes a console cover 140. Console cover 140 extends between an outer end 144 and an inner end 146, e.g., along the transverse direction T when door 116 is in the vertical or closed position. Console cover 140 also extends between a top and a bottom, e.g., along the vertical direction V when door 116 is in the vertical or closed position. Console cover 140 also extends between a first side and a second side, e.g., along the lateral direction L when door 116 is in the vertical or closed position. Console cover 140 has a body 142. Body 142 of console cover 140 has a top surface 148 and a bottom surface 150. Top surface 148 and bottom surface 150 are spaced from one another, e.g., along the vertical direction V when door 116 is in the vertical or closed position. Body 142 can have a vertical thickness of about one eighth of an inch, for example. Body 142 has one or more edges that extend between bottom surface 150 and top surface 148. Particularly, body 142 has an outer edge 152 at outer end 144 and an inner edge 154 at inner end 146 of console cover 140. Both the outer edge 152 and inner edge 154 extend generally in planes parallel to one another, and when door 116 is positioned in the vertical or closed position, orthogonal to the transverse direction T. Body 142 also has a first side edge at first side of console cover 140 and a second side edge at second side of console cover 140.

A tab 156 extends from body 142 at outer end 144 of console cover 140. Tab 156 has a top surface 158. Top surface 158 of tab 156 connects with outer edge 152 of body 142. A radiused section or connecting portion can connect top surface 158 of tab 156 and inner edge 154. As depicted, tab 156 extends further outward from tub 104 (FIG. 1) along the transverse direction T when door 116 is positioned in the vertical or closed position than body 142.

A circuit board 160 is mounted to bottom surface 150 of console cover 140. Controller 136 (FIG. 1) is communicatively coupled with circuit board 160. Controller 136 can be integral with circuit board 160, positioned onboard circuit board 160, or positioned offboard circuit board 160. For this embodiment, one or more light sources 170 are communicatively coupled with circuit board 160 (only one light source 170 is shown in FIGS. 3 and 4). Light source 170 is positioned on a bottom surface of circuit board 160. However, other suitable locations are possible. Light source 170 is operable to emit light into console cover 140. Circuit board 160 can define an opening 162 to permit light emitted by light source 170 to pass through circuit board 160 and into console cover 140. Light source 170 can be any suitable type of light emitting device, such as a light emitting diode. In some embodiments, the light source 170 and other light sources integrated with circuit board 160 can be aligned or in communication (e.g., positioned directly beneath) indicia 138 for the input selectors 134 of user interface 132. In this way, when controller 136 causes one of the light sources 170 to emit light, the illuminated indicia 138 can indicate the selected mode or setting to a user.

Console cover 140 is supported by a bracket 180 mounted to door 116. Generally, bracket 180 spans between outer panel 122 and inner panel 124 of door 116 along the transverse direction T. Bracket 180 engages bottom surface 150 of console cover 140 to provide support thereto. Bracket 180 defines a u-shaped bracket recess 182 that extends at least the lateral length of circuit board 160 along the lateral direction L and at least the transverse length of circuit board 160 along the transverse direction T. In this way, bracket recess 182 is sized to receive circuit board 160 and its various integrated electronic components. The inner end 146 of console cover 140 extends further inward than bracket 180 along the transverse direction T. Thus, inner end 146 of console cover 140 includes an overhang portion 155 that overhangs bracket 180. Notably, overhang portion 155 of console cover 140 is seated on a panel 126 of inner panel 124 of door 116. Accordingly, in some instances, inner edge 154 of console cover 140 is exposed to an ambient or exterior environment, e.g., when door 116 is moved to the open position.

As further depicted in FIGS. 2, 3, and 4, console assembly 130 includes a film 190. For this embodiment, film 190 is a light blocking film. That is, film 190 is operable to prevent light from passing therethrough. Film 190 is mounted to top surface 148 of console cover 140. Film 190 defines one or more light pass-through openings 192 through which light may pass. The light pass-through openings 192 are defined by film 190 such that they align with the various indicia 138 of user interface 132, e.g., along the lateral direction L and transverse direction T. Furthermore, for this embodiment, the light pass-through openings 192 are defined by film 190 such that they align with a corresponding light source 170, e.g., along the lateral direction L and transverse direction T. Accordingly, when controller 136 causes one of the light sources 170 to emit light (e.g., in response to a user input to one of the input selectors 134), light is directed from light source 170 through opening 162 of circuit board 160 and into console cover 140. At least a portion of the light directed into console cover 140 passes through its associated light pass-through opening 192 and illuminates indicia 138 corresponding to one or more input selectors 134 of user interface 132.

Console assembly 130 includes a bezel 200. Generally, bezel 200 is connected to door 116 at its top portion. Particularly, bezel 200 is connected to outer panel 122 of door 116 along its top portion. Bezel 200 extends longitudinally or lengthwise along the lateral direction L across outer panel 122 at its top portion. Bezel 200 also extends transversely along sidewalls of door 116 between inner panel 124 and outer panel 122. Notably, bezel 200 extends along the perimeter of console cover 140 except at inner end 146 of console cover 140 as shown in FIG. 2.

Bezel 200 includes a vertical portion 202 and a horizontal portion 204. Vertical portion 202 extends in a plane orthogonal to the transverse direction T when door 116 is in the vertical or closed position and horizontal portion 204 extends in a plane orthogonal to the vertical direction V when door 116 is in the vertical or closed position. Accordingly, bezel 200 has an L-shaped cross-section. Vertical portion 202 of bezel 200 is received within a recess of door 116. For instance, as shown in FIG. 3, vertical portion 202 of bezel 200 is received within a recess 128 defined by outer panel 122 of door 116. Horizontal portion 204 of bezel 200 is seated at least in part on tab 156 of console cover 140. A gap G is defined between bezel 200 and console cover 140. Particularly, a gap G is defined between horizontal portion 204 and body 142 of console cover 140.

In accordance with example aspects of the present disclosure, to prevent light from bleeding or escaping from console cover 140 when one or more light sources 170 direct light therein to ultimately illuminate one of the indicia 138, console cover 140 is formed at least in part of a non-clear resin. The resin can be a plastic resin, for example. As used herein, "non-clear resin" denotes a tinted or smoked resin that is substantially opaque. In some embodiments, the non-clear resin is tinted black. However, in other embodiments, the non-clear resin of console cover 140 can be tinted or smoked with other suitable dark colors, such as green, blue, purple, etc. Further, in some embodiments, console cover 140 is formed entirely of a non-clear resin, e.g., as shown in the embodiment of FIGS. 1 through 4. In such embodiments, console cover 140 can be formed by a single-shot injection molding process. In some embodiments, console cover 140 is formed at least in part of a non-clear resin and at least in part of a clear resin, as will be explained further herein. In such embodiments, console cover 140 can be formed by a multi-shot injection molding process, such as a double-shot injection molding process.

For the depicted embodiment of FIG. 4, the non-clear resin of console cover 140 is substantially opaque in that the non-clear resin material of console cover 140 allows some light, particularly direct light, to pass through console cover 140 and prevents or impedes other light, particularly non-direct or scattered light, from passing through console cover 140, e.g., by absorbing the light. Particularly, when controller 136 (FIG. 1) causes light source 170 to emit light L (e.g., in response to a user input to input selector 134), the emitted light L from light source 170 passes through opening 162 in circuit board 160 and enters console cover 140 through bottom surface 150. Some of the light L passes directly or substantially directly through the thickness of console cover 140 from bottom surface 150 to top surface 148. A portion of the emitted light L passes through light pass-through opening 192 and illuminates indicia 134 as shown in FIG. 4. Film 190 is formed of light blocking material(s) such that emitted light L is blocked or prevented from escaping from top surface 148 of console cover 140 (except the emitted light L may pass through light pass-through opening 192 as noted). The relatively thin thickness of console cover 140 allows for a portion of the emitted light L to travel therethrough to illuminate indicia 138 without being absorbed by the non-clear resin of console cover 140. In some embodiments, for example, body 142 of console cover 140 has a vertical thickness (a distance spanning from bottom surface 150 to top surface 148) of about one eighth of an inch (⅛ inch).

Some of the light L emitted by light source 170 does not pass through light pass-through opening 192 or any of the other light pass-through openings. For instance, some of the emitted light L can enter console cover 140 through bottom surface 150 and can travel generally toward outer end 144, e.g., forward along the transverse direction T toward the user. As the emitted light L travels generally toward inner end 146, the emitted light L is absorbed or substantially absorbed by the non-clear tinted resin of console cover 140. Accordingly, light bleed stemming from gap G defined between console cover 140 and bezel 200 is not visible to the human eye even with top surface 158 of tab 156 and outer edge 152 not covered by film 190. The relatively long distance between light source 170 and outer edge 152 allows for the emitted light L traveling toward outer end 144 to be sufficiently absorbed by the non-clear resin of console cover 140 such that light bleed from gap G is not visible to the human eye. In some embodiments, the distance between light source 170 and outer edge 152 is at least three (3) times greater than the thickness (i.e., the distance between bottom surface 150 and top surface 148) of console cover 140. For this embodiment, the distance between light source 170 and outer edge 152 is at least six (6) times greater than the thickness of console cover 140. In some embodiments, the distance between light source 170 and outer edge 152 is at least one (1) inch in length. Accordingly, light bleed from gap G is eliminated or substantially eliminated. That is, light bleed from the gap G is not visible to the human eye.

In addition, as further shown in FIG. 4, some of the emitted light L can enter console cover 140 through bottom surface 150 and can travel toward inner end 146 of console cover 140, e.g., rearward along the transverse direction T away from the user. The emitted light L traveling generally toward outer end 144 is absorbed or substantially absorbed by the non-clear tinted resin of console cover 140. Accordingly, emitted light L from light source 170 is not visible to the human eye from exposed inner edge 154 at inner end 146 of console cover 140. The relatively long distance between light source 170 and inner edge 154 allows for the emitted light L traveling toward inner end 146 to be sufficiently absorbed by the non-clear resin of console cover 140 such that light bleed from inner edge 154 is not visible to the human eye. In some embodiments, the distance between light source 170 and inner edge 154 is at least three (3) times greater than the thickness (i.e., the distance between bottom surface 150 and top surface 148) of console cover 140. In some embodiments, the distance between light source 170 and inner edge 154 is at least one (1) inch in length. Accordingly, light bleed from exposed inner edge 154 is eliminated or substantially eliminated. Stated differently, light bleed from exposed inner edge 154 is not visible to the human eye.

Advantageously, as console cover 140 is formed at least in part of non-clear resin, or entirely of non-clear resin in the example embodiment of FIGS. 1 through 4, light bleed from the inner and/or outer edges 152, 154 and/or surfaces of tab 156 is prevented or substantially impeded such that light emanating from such edges/surfaces is not visible to the human eye. Furthermore, as console cover 140 is formed at least in part of non-clear resin, no additional steps of painting the inner and/or outer edges 152, 154 or surfaces of tab 156 are needed to prevent light bleed from such edges and surfaces. In addition, no design changes or additions are necessary to add light blocking components to cover the edges/surfaces. In addition, more flexibility for light source brightness/selection/placement is provided by forming console cover 140 at least in part of non-clear resin.

Figure 5:
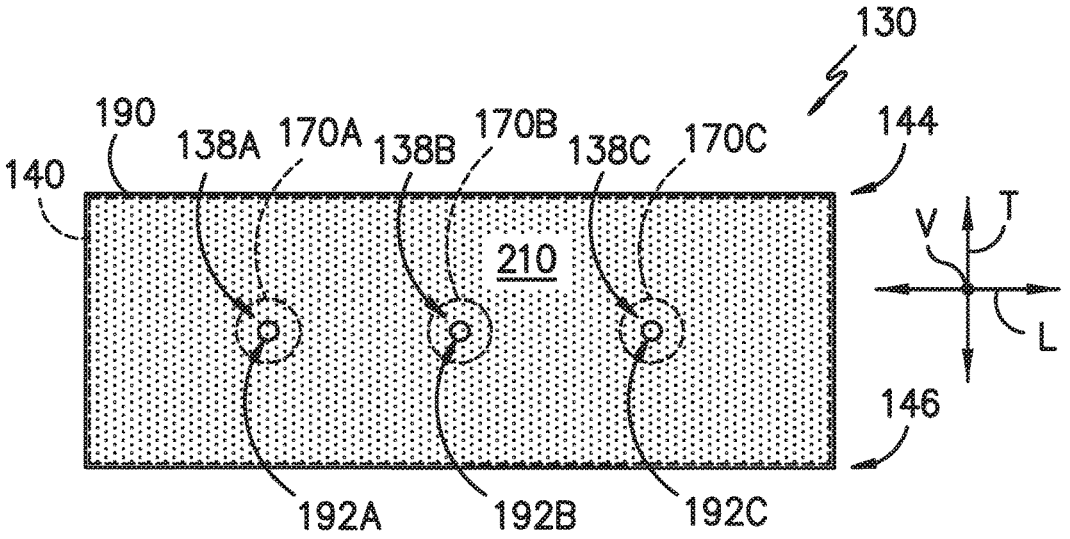
FIG. 5 provides a schematic top plan view of an example embodiment of a console assembly that may be incorporated into the dishwasher appliance of FIG. 1.

FIG. 5 provides a schematic top plan view of some elements of a console assembly 130 that may be incorporated in dishwasher 100 of FIG. 1. In FIG. 5, film 190 is shown transparent for illustrative purposes to depict console cover 140 formed entirely of a non-clear resin 210. As illustrated, console assembly 130 includes a first light source 170A aligned or in communication with a first light pass-through opening 192A defined by film 190, a second light source 170B aligned or in communication with a second light pass-through opening 192B defined by film 190, and a third light source 170C aligned or in communication with a third light pass-through opening 192C defined by film 190. The light sources 170A, 170B, 170C are positioned directly beneath their respective light pass-through openings 192A, 192B, 192C along the vertical direction V. For instance, the light sources 170A, 170B, 170C can be mounted to a circuit board (not shown in FIG. 5) mounted to a bottom surface of console cover 140. As in the embodiment of FIGS. 1 through 4, direct light emitted by one or more of light sources 170A, 170B, 170C may pass through console cover 140 and exit their respective light pass-through openings 192A, 192B, 192C to illuminate their respective indicia 138A, 138B, 138C. Further, non-direct or scattered light in console cover 140 is absorbed by the non-clear resin 210 of console cover 140 such that light bleed from outer edge 152 and/or inner edge 154/top surface 158 of tab 156 through gap G is not visible to the human eye. For the embodiment of FIG. 5, console cover 140 can be formed by a single-shot injection molding process using the non-clear resin.

Figure 6:
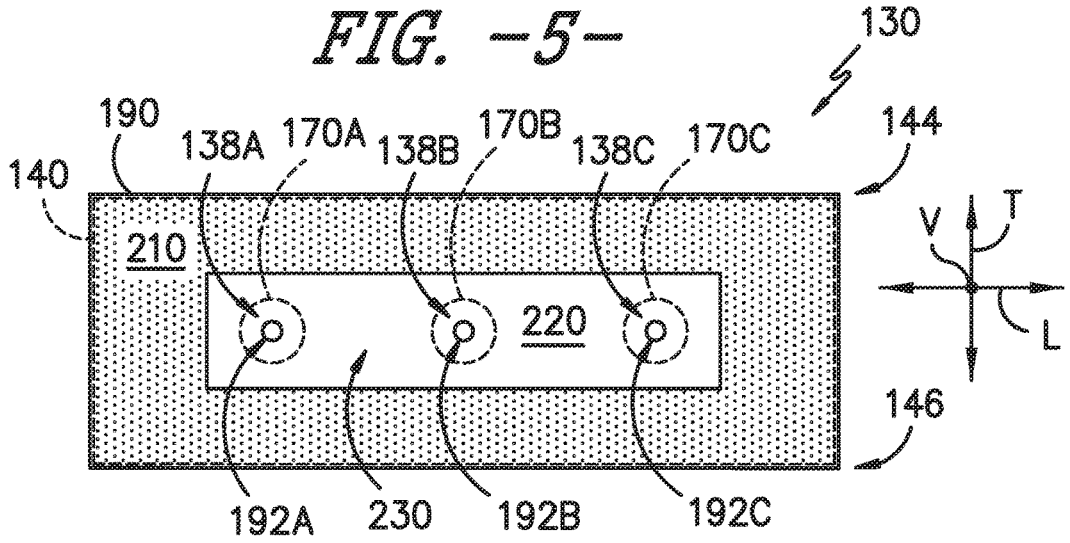
FIG. 6 provides a schematic top plan view of another example embodiment of a console assembly that may be incorporated into the dishwasher appliance of FIG. 1.

FIG. 6 provides a schematic top plan view of another example embodiment of a console assembly 130 that may be incorporated in dishwasher 100 of FIG. 1. Console assembly 130 of FIG. 6 is configured in substantially the same manner as the console assembly of FIG. 5 except as provided below. For the depicted embodiment of FIG. 6, film 190 is shown transparent for illustrative purposes to depict console cover 140 formed in part of a non-clear resin 210 and in part of a clear resin 220. The clear resin 220 of console cover 140 is substantially transparent and allows substantially all emitted light to pass therethrough. The clear resin 220 portion of console cover 140 defines a light zone 230 that surrounds the various light sources, including a first light source 170A, a second light source 170B, and a third light source 170C. The light zone 230 defined by the clear resin 220 extends between the bottom surface and the top surface of console cover 140, e.g., along the vertical direction V, but as shown in FIG. 6, the light zone 230 does not extend to the inner end 146 or the outer end 144 along the transverse direction T. Moreover, the light zone 230 does not extend to the first side or the second side of console cover 140 along the lateral direction L. Accordingly, the light sources 170A, 170B, 170C are surrounded by non-clear resin 210 along the lateral and transverse directions L, T.

In this manner, direct light emitted by one or more of light sources 170A, 170B, 170C may pass through console cover 140 and exit their respective light pass-through openings 192A, 192B, 192C to illuminate their respective indicia 138A, 138B, 138C. As the emitted light passes through clear resin 220, the direct emitted light is not or only absorbed by non-clear resin 210 in a negligible manner, which may advantageously increase the lumen intensity of the illuminated indicia (e.g., compared to direct light that passes through non-clear resin 210) or a less bright light source can be selected to achieve the same lumen intensity output. Further, any non-direct or scattered light in console cover 140 is absorbed by the non-clear resin 210 surrounding light zone 230 defined by clear resin 220 of console cover 140 such that light bleed from outer edge 152 and/or inner edge 154/top surface 158 of tab 156 through gap G is not visible to the human eye. For the embodiment of FIG. 6, console cover 140 can be formed by a double-shot injection molding process using the non-clear resin 210 in a first shot and the clear resin 220 in a second shot.

Figure 7:
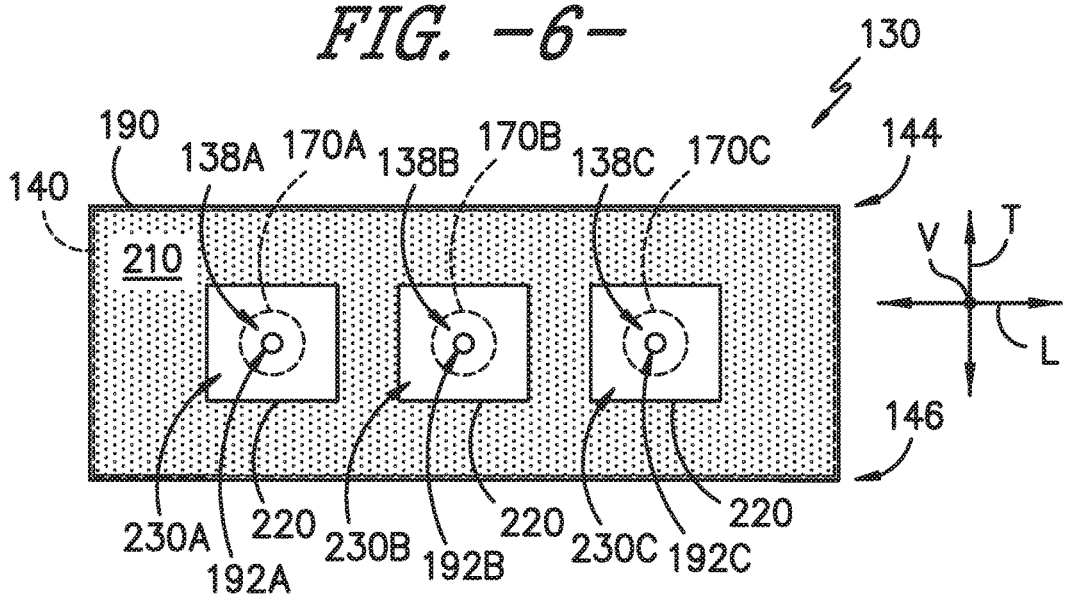
FIG. 7 provides a schematic top plan view of yet another example embodiment of a console assembly that may be incorporated into the dishwasher appliance of FIG. 1.

FIG. 7 provides a schematic top plan view of another example embodiment of a console assembly 130 that may be incorporated in dishwasher 100 of FIG. 1. Console assembly 130 of FIG. 7 is configured in substantially the same manner as the console assembly of FIG. 6 except as provided below. For the depicted embodiment of FIG. 7, film 190 is shown transparent for illustrative purposes to depict console cover 140 formed in part of a non-clear resin 210 and in part of a clear resin 220. Notably, for this embodiment, the clear resin 220 is partitioned into defined light zones, including a first light zone 230A associated with first light source 170A and first light pass-through opening 192A, a second light zone 230B associated with second light source 170B and second light pass-through opening 192B, and a third light zone 230C associated with third light source 170C and third light pass-through opening 192C. As depicted in FIG. 7, each light zone 230A, 230B, 230C extends the vertical thickness of console cover 140 and is surrounded by non-clear resin 210 along the lateral and transverse directions L, T. Accordingly, not only is light prevented from bleeding from the outer edges of console cover 140 so as not to be visible to the human eye, inadvertent light bleed between light sources 170A, 170B, 170C is reduced or eliminated. For example, if first light source 170A emits light, the non-clear resin 210 positioned between first light zone 230A and second light zone 230B prevents light emitted from first light source 170A from bleeding through second light pass-through opening 192B to illuminate second indicia 138B. Console cover 140 can be formed by a multi-shot injection molding process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An appliance, comprising:

a cabinet;

a door operatively coupled with the cabinet and movable between a closed position and an open position;

a console assembly mounted to the door, the console assembly comprising:

a console cover having a top surface and a bottom surface spaced from the top surface;

a plurality of light sources positioned below the bottom surface of the console cover, each of the plurality of light sources operable to emit light into the console cover;

a light blocking film mounted to the top surface of the console cover, the light blocking film operable to prevent light from passing therethrough and defining a plurality of light pass-through openings through which light passes when the plurality of light sources emit light; and a circuit board mounted to the bottom surface of the console cover, at least one of the plurality of light sources being mounted to a bottom surface of the circuit board, the circuit board defining an opening that allows light emitted by the at least one of the plurality of light sources to pass through the circuit board and into the console cover, and wherein the console cover is formed at least in part of a non-clear resin and at least in part of a clear resin, and wherein the clear resin defines a light zone extending between the bottom surface and the top surface of the console cover, the light zone being surrounded by the non-clear resin, and wherein each one of the plurality of light sources and each one of the plurality of light pass-through openings is aligned with the light zone.

2. The appliance of claim 1, wherein the console cover has a thickness extending between the top surface and bottom surface, and wherein the console cover has an outer edge and an inner edge spaced from the outer edge, and wherein a distance between each one of the plurality of light sources and the inner edge is at least three times greater than the thickness of the console cover.

3. The appliance of claim 2, wherein a distance between each one of the plurality of light sources and the outer edge is at least three times greater than the thickness of the console cover.

4. The appliance of claim 3, wherein the non-clear resin of the console cover is substantially opaque such that light emitted by the plurality of light sources that passes through the console cover and the plurality of light pass-through openings is visible to a human eye and such that light emitted by the plurality of light sources that passes through the console cover is not visible to the human eye at the inner edge or at the outer edge.

5. The appliance of claim 1, wherein the console cover extends between an inner end and an outer end, the console cover having a body and a tab extending from the body at the outer end, and wherein the appliance further comprises:

a bezel mounted to the door and seated at least in part on the tab of the console cover, wherein a gap is defined between the bezel and the console cover, and wherein the non-clear resin is substantially opaque such that light bleed from the gap is not visible to the human eye.

6. The appliance of claim 1, wherein the console cover extends between an inner end and an outer end, the console cover having an inner edge at the inner end that is exposed, and wherein the non-clear resin is substantially opaque such that light bleed from the inner edge is not visible to the human eye.

7. The appliance of claim 1, wherein the appliance is a dishwasher appliance.

8. The appliance of claim 1, wherein the plurality of light sources include a first light source, a second light source, and a third light source.

9. A dishwasher appliance, comprising:

a cabinet;

a tub positioned within the cabinet and defining a wash chamber for receipt of articles for washing;

a door operatively coupled with the cabinet and movable between a closed position and an open position for providing selective access to the wash chamber;

a console assembly mounted to the door, the console assembly comprising:

a console cover having a top surface, a bottom surface spaced from the top surface, and one or more edges extending between the bottom surface and the top surface;

a plurality of light sources positioned below the bottom surface of the console cover, the plurality of light sources operable to emit light into the console cover; and a light blocking film mounted to the top surface of the console cover, the light blocking film operable to prevent light from passing therethrough and defining a plurality of light pass-through openings through which light passes when the plurality of light sources emit light; and a circuit board mounted to the bottom surface of the console cover, at least one of the plurality of light sources being mounted to a bottom surface of the circuit board, the circuit board defining an opening that allows light emitted by the at least one of the plurality of light sources to pass through the circuit board and into the console cover, wherein the console cover is formed at least in part of a non-clear resin that is substantially opaque and at least in part of a clear resin, and wherein the clear resin defines a light zone extending between the bottom surface and the top surface of the console cover, the light zone being surrounded by the non-clear resin, and wherein each one of the plurality of light sources and each one of the plurality of light pass-through openings is aligned with the light zone so that, when light is emitted by the plurality of light sources, light emitted by the plurality of light sources that passes through the light zone defined by the clear resin of the console cover and the plurality of light pass-through openings is visible to a human eye and light scattered through the non-clear resin is not visible to the human eye from the one or more edges.

10. The dishwasher appliance of claim 9, wherein the console cover has a thickness extending between the top surface and bottom surface, and wherein the one or more edges of the console cover include an outer edge and an inner edge spaced from the outer edge, and wherein a distance between each one of the plurality of light sources and the inner edge is at least three times greater than the thickness of the console cover.

11. The dishwasher appliance of claim 10, wherein a distance between each one of the plurality of light sources and the outer edge is at least three times greater than the thickness of the console cover.

12. The dishwasher appliance of claim 10, wherein the plurality of light sources include a first light source, a second light source, and a third light source.

13. The dishwasher appliance of claim 9, wherein the console cover extends between an inner end and an outer end, the console cover having a body and a tab extending from the body at the outer end, and wherein the appliance further comprises:

a bezel mounted to the door and seated at least in part on the tab of the console cover, wherein a gap is defined between the bezel and the console cover, and wherein the non-clear resin is substantially opaque such that light bleed from the gap is not visible to the human eye.

14. The dishwasher appliance of claim 9, wherein the console cover extends between an inner end and an outer end, the one or more edges including an inner edge at the inner end that is exposed, and wherein the non-clear resin is substantially opaque such that light bleed from the inner edge is not visible to the human eye.

15. An appliance, comprising:

a cabinet;

a tub positioned within the cabinet and defining a wash chamber for receipt of articles for washing;

a door operatively coupled with the cabinet and movable between a closed position and an open position for providing selective access to the wash chamber;

a console assembly mounted to the door, the console assembly comprising:

a console cover having a top surface, a bottom surface spaced from the top surface, an outer edge, and an inner edge spaced from the outer edge, the inner edge and the outer edge both extending between the top surface and the bottom surface, the console cover having a thickness extending between the top surface and bottom surface, and wherein the console cover is formed entirely of a non-clear resin that is substantially opaque;

a plurality of light sources positioned below the bottom surface of the console cover, the plurality of light sources operable to emit light into the console cover, wherein a distance between each one of the plurality of light sources and the outer edge is at least three times greater than the thickness of the console cover;

a circuit board mounted to the bottom surface of the console cover, at least one of the plurality of light sources being mounted to a bottom surface of the circuit board, the circuit board defining an opening that allows light emitted by the at least one of the plurality of light sources to pass through the circuit board and into the console cover, and a light blocking film mounted to the top surface of the console cover, the light blocking film operable to prevent light from passing therethrough and defining a plurality of light pass-through openings through which light passes when the plurality of light sources emit light, and wherein the outer edge of the console cover is not covered by the light blocking film.

16. The appliance of claim 15, wherein the distance between each one of the plurality of light sources and the outer edge is at least six times greater than the thickness of the console cover.

* * * * *